US010535328B2

(12) United States Patent
Liu et al.

(10) Patent No.: US 10,535,328 B2
(45) Date of Patent: Jan. 14, 2020

(54) AUTOMATIC PLAYING SYSTEM

(71) Applicant: SUNLAND INFORMATION TECHNOLOGY CO., LTD., Shanghai (CN)

(72) Inventors: Xiaolu Liu, Shanghai (CN); Zhengchun Li, Shanghai (CN)

(73) Assignee: SUNLAND INFORMATION TECHNOLOGY CO., LTD., Shanghai (CN)

( * ) Notice: Subject to any disclaimer, the term of this patent is extended or adjusted under 35 U.S.C. 154(b) by 0 days.

(21) Appl. No.: 16/133,891

(22) Filed: Sep. 18, 2018

(65) Prior Publication Data

US 2019/0019480 A1 Jan. 17, 2019

Related U.S. Application Data

(63) Continuation of application No. PCT/CN2017/071496, filed on Jan. 18, 2017.

(51) Int. Cl.

| | |
|---|---|
| ***G10F 5/02*** | (2006.01) |
| ***G10F 1/02*** | (2006.01) |
| ***G10C 3/166*** | (2019.01) |
| ***G10C 3/26*** | (2019.01) |

(52) U.S. Cl.

CPC ..... *G10F 5/02* (2013.01); *G10C 3/166* (2013.01); *G10C 3/26* (2013.01); *G10F 1/02* (2013.01)

(58) Field of Classification Search

CPC .. G10F 5/02; G10F 1/02; G10C 3/166; G10C 3/26

USPC ..... 84/21

See application file for complete search history.

(56) References Cited

U.S. PATENT DOCUMENTS

| | | | | | |
|---|---|---|---|---|---|
| 1,603,873 | A | * | 10/1926 | Sandell | G10F 5/02 335/254 |
| 1,935,215 | A | * | 11/1933 | Severy | G10H 3/20 84/19 |
| 2,308,051 | A | * | 1/1943 | Cahill | G10H 1/00 84/680 |
| 2,919,619 | A | * | 1/1960 | Munzfeld | G10C 3/30 84/443 |

(Continued)

FOREIGN PATENT DOCUMENTS

| | | |
|---|---|---|
| CN | 2722376 Y | 8/2005 |
| CN | 201655284 U | 11/2010 |

OTHER PUBLICATIONS

International Search Report for PCT/CN2017/071496 dated Nov. 1, 2017, 5 pages.

(Continued)

*Primary Examiner* — David S Warren
*Assistant Examiner* — Christina M Schreiber
(74) *Attorney, Agent, or Firm* — Metis IP LLC

(57) ABSTRACT

An automatic playing system may include a damper module for changing a sound generated by the automatic playing system. The damper module may include a damper board, a motion driver, and a supporter. The damper board may be configured to control at least one damper of the automatic playing system. The motion driver may be configured to drive the damper board and operated to perform at least one automatic playing function. The supporter may be configured to couple the damper board with the motion driver when the motion driver is operated.

18 Claims, 6 Drawing Sheets

(56) References Cited

U.S. PATENT DOCUMENTS 4,513,652 A * 4/1985 Muramatsu ..... G10F 1/02 84/107
4,741,237 A * 5/1988 Murakami ..... G10F 1/02 84/20
5,545,839 A * 8/1996 Kawamura ..... G10C 5/10 84/171
6,288,313 B1 * 9/2001 Sato ..... G10C 3/02 84/177
7,521,626 B2 * 4/2009 Muramatsu ..... G10H 1/0066 84/626
9,502,014 B1 * 11/2016 Fujiwara ..... G10F 5/02
2005/0211079 A1 * 9/2005 Sasaki ..... G10F 1/02 84/723
2006/0130640 A1 * 6/2006 Fujiwara ..... G10F 1/02 84/626
2007/0256550 A1 * 11/2007 Muramatsu ..... G10H 1/0066 84/719
2010/0288102 A1 * 11/2010 Fujiwara ..... G10F 1/02 84/13
2013/0180376 A1 * 7/2013 Matsuo ..... G10C 3/26 84/225
2013/0180377 A1 * 7/2013 Oba ..... G10C 3/26 84/229
2013/0180391 A1 * 7/2013 Oba ..... G10F 1/02 84/746
2014/0305286 A1 * 10/2014 Fujiwara ..... G10F 1/02 84/603
2018/0322856 A1 * 11/2018 Liu ..... G01P 13/00
2019/0019480 A1 * 1/2019 Liu ..... G10C 3/166

OTHER PUBLICATIONS

Written Opinion of the International Searching Authority for PCT/CN2017/071496 dated Nov. 1, 2017, 4 pages.

* cited by examiner

AUTOMATIC PLAYING SYSTEM

CROSS-REFERENCE TO RELATED APPLICATIONS

This application is a continuation of International Application No. PCT/CN2017/071496, filed on Jan. 18, 2017, designating the United States of America, the contents of which are hereby incorporated by reference.

TECHNICAL FIELD

This present disclosure relates to an automatic playing system, and more particularly, to an automatic playing system with damper automatic playing functions.

BACKGROUND

An automatic playing piano may provide self-playing functions in an automatic mode to auto play music. When the automatic playing piano is not in the automatic mode (e.g., an "acoustic" mode), the automatic playing piano may be played by a pianist. A damper pedal is a commonly used piano pedal that can sustain played notes. Conventional mechanisms for implementing a damper pedal in an automatic player piano may include using the same drive rod in both the automatic mode and the acoustic mode and driving a damper using an additional lever. However, these conventional mechanisms are complicated and unstable.

SUMMARY

In an aspect of the present disclosure, an automatic playing system is provided. The automatic playing system may include a damper module for changing a sound generated by the automatic playing system. In some embodiments, the damper module may include a damper board, a motion driver, and a supporter. The damper board may be configured to control at least one damper of the automatic playing system. The motion driver may be configured to drive the damper board and operated to perform at least one automatic playing function. The supporter may be configured to couple the damper board with the motion driver when the motion driver is operated.

In some embodiments, the motion driver may include a solenoid and an iron core.

In some embodiments, the damper may be configured to control movements of at least one string of the automatic playing system.

In some embodiments, when the motion driver is operated to perform the automatic playing function, the iron core may move upward and the damper board may be raised up by the iron core through the supporter.

In some embodiments, when the damper board is raised up, the damper board may cause the damper to move away from the string of the automatic playing system.

In some embodiments, a diameter of a second portion of the iron core may be larger than at least one of a diameter of a first portion of the iron core or a diameter of a third portion of the iron core.

In some embodiments, the first portion of the iron core may be in contact with the supporter when the motion driver is operated.

In some embodiments, the first portion of the iron core may be spaced apart from the supporter when the motion driver is not operated.

In some embodiments, the solenoid may further include a coil and a cavity installed beneath the coil. The coil may be configured to generate a magnetic field when the motion driver is operated.

In some embodiments, the second portion of the iron core may be encircled by the coil of the solenoid.

In some embodiments, the cavity of the solenoid may include a hole configured to guide the third portion of the iron core to pass through the cavity of the solenoid.

In some embodiments, the damper module may include an elastic sleeve installed on a part of the supporter.

In some embodiments, the elastic sleeve may be made of rubber.

In some embodiments, the damper module may include a bushing installed in the hole of the cavity.

In some embodiments, the bushing may be made of polyformaldehyde.

In some embodiments, the damper module may include a first silencer installed on the bottom of the cavity.

In some embodiments, the second portion of the iron core may include a rim near the junction of the second portion and the third portion of the iron core.

In some embodiments, the damper module may include a second silencer installed on the rim of the second portion of the iron core.

In some embodiments, the first or the second silencer may be made of woolen felt.

In some embodiments, the automatic playing system may further include a keybed. The keybed may be configured to be fixed with the motion driver.

Additional features will be set forth in part in the description which follows, and in part will become apparent to those skilled in the art upon examination of the following and the accompanying drawings or may be learned by production or operation of the examples. The features of the present disclosure may be realized and attained by practice or use of various aspects of the methodologies, instrumentalities and combinations set forth in the detailed examples discussed below.

BRIEF DESCRIPTION OF THE DRAWINGS

The present disclosure is further described in terms of exemplary embodiments. These exemplary embodiments are described in detail with reference to the drawings. These embodiments are non-limiting exemplary embodiments, in which like reference numerals represent similar structures throughout the several views of the drawings, and wherein.

DETAILED DESCRIPTION

In the following detailed description, numerous specific details are set forth by way of example in order to provide a thorough understanding of the relevant disclosure. However, it should be apparent to those skilled in the art that the present disclosure may be practiced without such details. In other instances, well-known methods, procedures, systems, components, and/or circuitry have been described at a relatively high-level, without detail, in order to avoid unnecessarily obscuring aspects of the present disclosure. Various modifications to the disclosed embodiments will be readily apparent to those skilled in the art, and the general principles defined herein may be applied to other embodiments and applications without departing from the spirit and scope of the present disclosure. Thus, the present disclosure is not limited to the embodiments shown, but to be accorded the widest scope consistent with the claims.

It will be understood that the term "system," "device," "apparatus," and/or "module" used herein are one method to distinguish different components, elements, parts, sections or assemblies of different level in ascending order. However, the terms may be exchanged or displaced by other expression if they may achieve the same purpose.

It will be understood that when a device, apparatus, module, component or part is referred to as being "on," "connected to," or "coupled to" another device, apparatus, module, component, or part, it may be directly on, connected or coupled to, or communicate with the other device, apparatus, module, component, or part, or an intervening device, apparatus, module, component, or part may be present, unless the context clearly indicates otherwise. As used herein, the term "and/or" includes any and all combinations of one or more of the associated listed items.

The terminology used herein is for the purposes of describing particular examples and embodiments only, and is not intended to be limiting. As used herein, the singular forms "a," "an," and "the" may be intended to include the plural forms as well, unless the context clearly indicates otherwise. It will be further understood that the terms "include" and/or "comprise," when used in this disclosure, specify the presence of integers, devices, behaviors, stated features, steps, elements, operations, and/or components, but do not exclude the presence or addition of one or more other integers, devices, behaviors, features, steps, elements, operations, components, and/or groups thereof.

Figure 1:
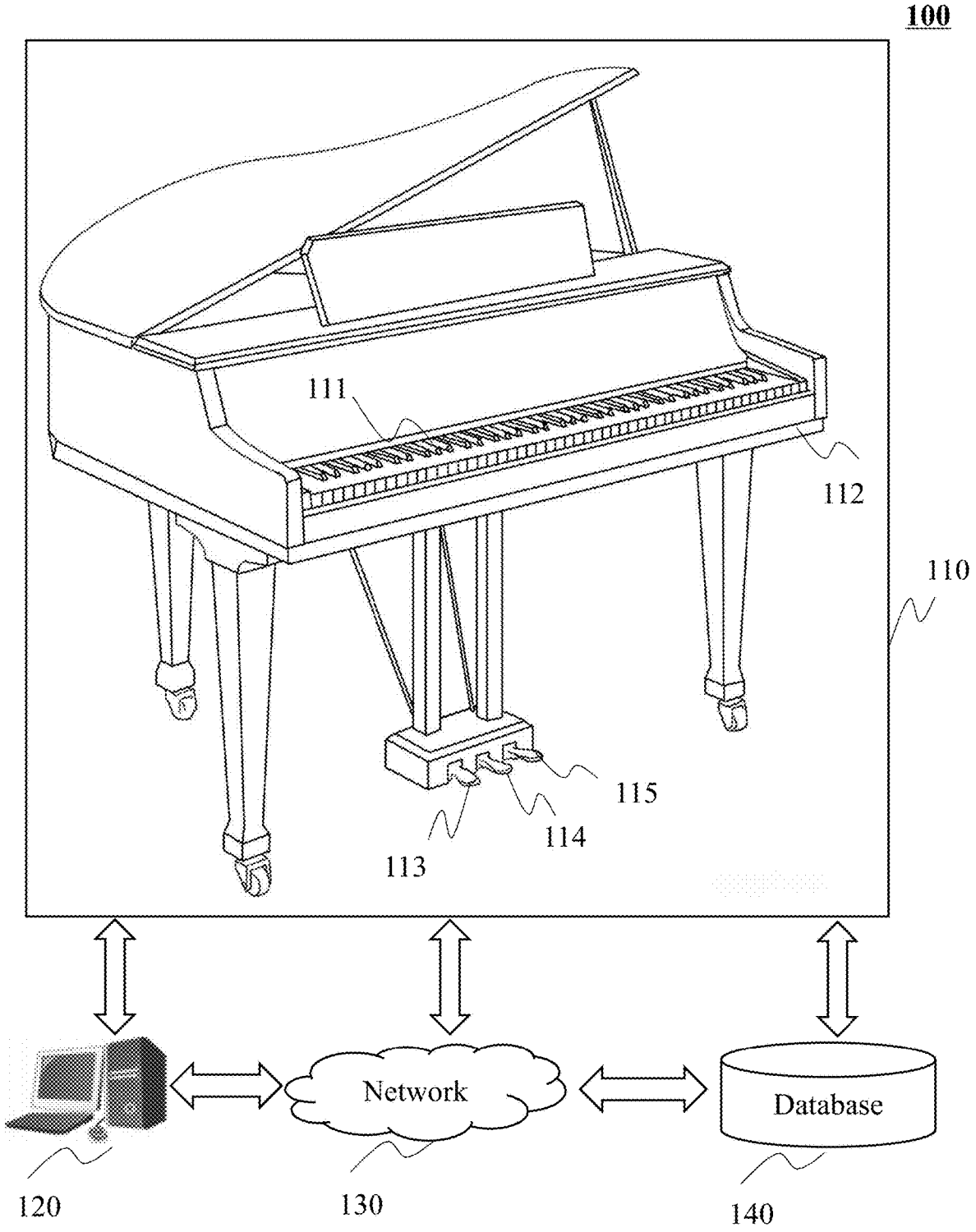
FIG. 1 is a block diagram of an exemplary automatic playing system according to some embodiments of the present disclosure.

FIG. 1 is a block diagram of an exemplary automatic playing system according to some embodiments of the present disclosure. Automatic playing system 100 may be used in various fields including, for example, personal use, music program, concert performance, music exchange, house concert, music education, music festival, or the like, or any combination thereof. As illustrated in FIG. 1, automatic playing system 100 may include an automatic playing device 110, a processor 120, a network 130, and a database 140.

Automatic playing device 110 may be an instrument configured to perform music. For example, automatic playing device 110 may include a piano (e.g., an upright piano, a grand piano, an electrical piano, a piano accordion, an organ, an electrical keyboard, etc.), a harp, a violoncello, a viola, a guitar, a ukulele, a harpsichord, a zither, or the like, or any combination thereof. In some embodiments, automatic playing device 110 may operate in one or more working modes, such as a first mode, a second mode, a third mode, etc. The working modes may include, for example, an automatic playing mode, a semi-automatic playing mode, a manual playing mode, etc. In the automatic playing mode, automatic playing device 110 may play music by itself without user participation. In the semi-automatic playing mode, a user may play music with the cooperation of automatic playing device 110. In the manual playing mode, automatic playing device 110 may be played by the user.

For better understanding the present disclosure, an automatic playing piano may be described as an example of automatic playing device 110. It should be noted that the automatic playing piano described below is merely provided for illustration purposes, and not intended to limit the scope of the present disclosure. In some embodiments, automatic playing device 110 may include a keyboard 111, a keybed 112, a soft pedal 113, a sostenuto pedal 114, and a damper pedal 115.

Keyboard 111 may include one or more keys (e.g., 88 keys). Automatic playing device 110 may include one or more hammers, strings, and dampers (not shown in FIG. 1). In some embodiments, a key of keyboard 111 may correspond to a hammer, a string, and a damper. When the key is depressed, the hammer may strike the string in response to movements of the key. The damper that is originally in contact with the string may move away from the string at the same time. A sound may then be generated. When the key is released, the hammer may move away from the string. The damper may return to its original position and stops the string's vibration, ending the sound. Keybed 112 may be configured to support keyboard 111 and other components of automatic playing device 110.

Soft pedal 113 may be configured to soften or weaken a sound produced by automatic playing device 110. In some embodiments, when soft pedal 113 is operated, the hammer corresponding to a key of keyboard 111 may deviate its original position slightly. When the key is depressed, the hammer cannot strike its corresponding string completely. Sounds generated by the corresponding string may then be softened or weakened. In some embodiments, when soft pedal 113 is operated, the hammer corresponding to a key of keyboard 111 may move closer to its corresponding string. When the key is depressed, the hammer may strike its corresponding string with a smaller distance or a less strength. Sounds generated by the corresponding string may then be weakened.

Sostenuto pedal 114 may be configured to selectively weaken or prolong a sound produced by automatic playing device 110. In some embodiments, sostenuto pedal 114 may also be referred to as a muffler pedal. In some embodiments, automatic playing device 110 may include a piece of muting material (e.g., flannel cloth). When sostenuto pedal 114 is operated, the muting material may be positioned between a hammer and its corresponding string. Sounds generated by the corresponding string may then be weakened. In some embodiments, when sostenuto pedal 114 is operated, the damper may move away from its corresponding string. Sounds generated by the corresponding string may then be prolonged.

Damper pedal 115 may be configured to prolong a sound produced by automatic playing device 110. In some embodiments, damper pedal 115 may also be referred to as a "sustain pedal," "sustaining pedal," "loud pedal," or "open pedal." When damper pedal 115 is operated, all dampers of automatic playing device 110 may move away from their corresponding strings. Sounds generated by the corresponding strings may sustain until the vibration naturally ceases and/or until damper pedal 115 is released.

It should be noted that the above description about automatic playing device 110 is merely for the purposes of illustration, and not intended to limit the scope of the present disclosure. For persons having ordinary skills in the art, multiple variations and modifications may be made under the teaching of the present disclosure. In some embodiments, automatic playing device 110 may include some other components, such as a display, an input apparatus, a communication interface, a power source, etc. In some embodiments, the pedals in automatic playing device 110 may be added or omitted. For example, soft pedal 113 and/or sostenuto pedal 114 may be omitted in some scenarios. However, those variations and modifications do not depart from the scope of the present disclosure.

Processor 120 may be configured to process information related to automatic playing system 100. In some embodiments, processor 120 may perform operations including, for example, processing data, editing musical instrument digital interface (MIDI) files, setting parameters, selecting playing modes, controlling operations of one or more other components of system 100 (e.g., a damper module), or the like, or any combination thereof. In some embodiments, the data processed and/or generated by processor 120 may be transmitted to one or more other components of automatic playing system 100, such as automatic playing device 110 and/or database 140. In some embodiments, the data processed and/or generated by processor 120 may be transmitted to a storage device for storing (not shown). In some embodiments, the data processed and/or generated by processor 120 may be transmitted to and displayed by one or more other components of automatic playing device 110. In some embodiments, the data processed and/or generated by processor 120 may be transmitted to an external device (e.g., a remote terminal) through network 130.

Figure 2:
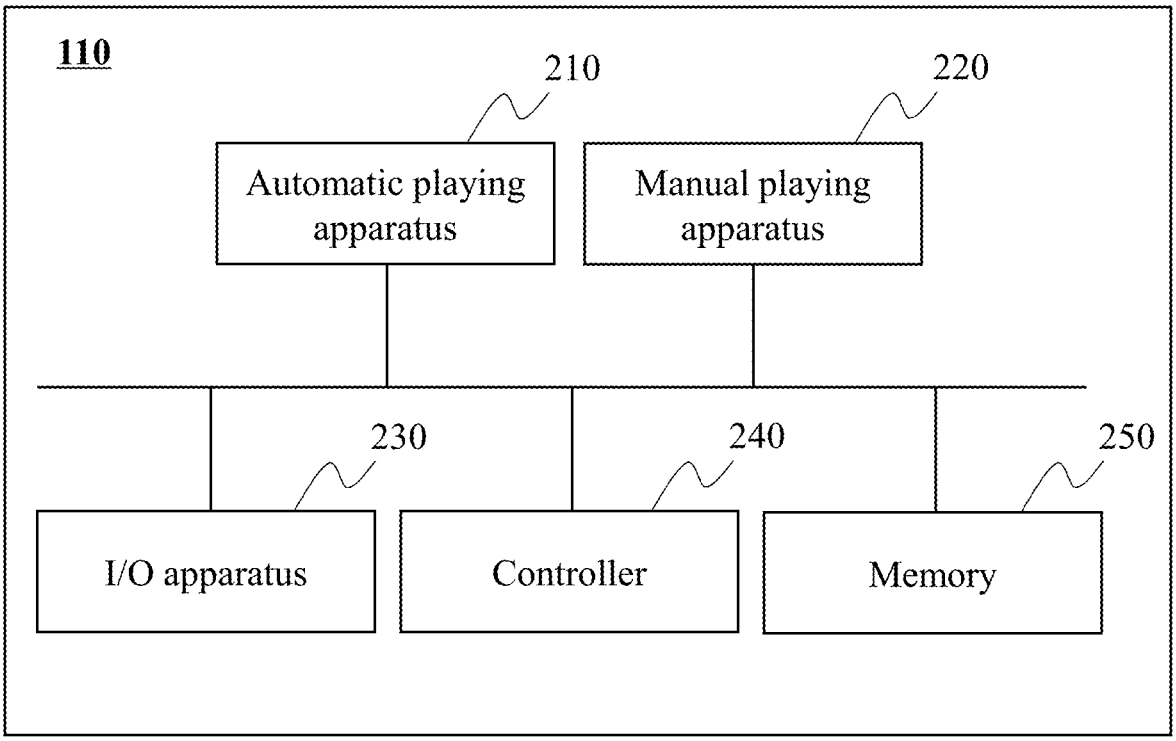
FIG. 2 is a block diagram of an exemplary automatic playing device according to some embodiments of the present disclosure.

In some embodiments, processor 120 may generate a control signal for controlling one or more components of automatic playing system 100. For example, processor 120 may control musical tone, key press strength, pedal motion driver, playing speed, and/or on/off state of the key of automatic playing device 110. As another example, processor 120 may receive a command provided by a user through, for example, the I/O apparatus of automatic playing device 110 (as illustrated in FIG. 2). In some embodiments, processor 120 may control communication between components of automatic playing system 100. For example, processor 120 may control information transmission from automatic playing device 110 to database 140, and vice versa.

In some embodiments, processor 120 may include a processor-based and/or microprocessor-based unit. Merely by way of example, processor 120 may include one or more hardware processors, such as a microcontroller, a reduced instruction set computer (RISC), an application specific integrated circuits (ASICs), an application-specific instruction-set processor (ASIP), a central processing unit (CPU), a graphics processing unit (GPU), a physics processing unit (PPU), a microcontroller unit, a digital signal processor (DSP), a field-programmable gate array (FPGA), an advanced RISC machine (ARM), or any other circuit or processor capable of executing one or more functions described herein. In some embodiments, processor 120 may also include a memory (e.g., a random access memory (RAM) or a read-only memory (ROM).

It should be noted that the above description about processor 120 is merely for the purposes of illustration, and not intended to limit the scope of the present disclosure. For persons having ordinary skills in the art, multiple variations and modifications may be made under the teaching of the present disclosure. Merely by way of example, processor 120 may be implemented in various manners. In some embodiments, processor 120 may be incorporated into automatic playing device 110. In some embodiments, processor 120 may be implemented by hardware, software, and/or a combination of hardware and software (e.g., firmware). The hardware may include a hardware circuit, a programmable logic device, an ultra large scale integrated circuit, a gate array chip, a semiconductor device (e.g., a transistor), or a field-programmable gate array (FPGA).

Network 130 may be configured to facilitate communications among the components of smart instrument system 100. For example, network 130 may transmit data from automatic playing device 110 to processor 120. Network 130 may also transmit data processed and/or generated by processor 120 to automatic playing device 110. In some embodiments, network 130 may include a wired network, a wireless network, an Ethernet, etc. that allows transmission and receipt of data. In some embodiments, network 130 may include a nanoscale network, a near field communication (NFC), a body area network (BAN), a personal area network (PAN, e.g., a Bluetooth, a Z-Wave, a Zigbee, a wireless USB), a near-me area network (NAN), a local wireless network, a backbone, a metropolitan area network (MAN), a wide area network (WAN), an internet area network (IAN, or cloud), or the like, or any combination thereof.

Database 140 may be configured to acquire and/or store information of the components of automatic playing system 100. For example, database 140 may acquire information of the user playing musical instrument 110. In some embodiments, the information acquired and/or stored may include programs, software, algorithms, functions, files, parameters, data, texts, numbers, images, or the like, or any combination thereof. Merely by way of example, database 140 may store songs with different formats including, for example, CD, WAVE, AIFF, AU, MPEG, MP3, MPEG-4, MIDI, WMA, RealAudio, VQF, OggVorbis, AMR, or the like, or any combination thereof. In some embodiments, database 140 may also store a song format exchanger which may exchange a non-MIDI format song into MIDI format to control automatic playing of automatic playing system 100.

In some embodiments, two or more components of automatic playing system 100 may be integrated together. For example, automatic playing device 110 and processor 120 may be integrated into one device. In some embodiments, one or more of the components may be installed remotely from each other. Merely by way of example, processor 120 may be implemented on a cloud platform (e.g., a cloud computing platform or a cloud storing platform). As another example, automatic playing device 110 may be controlled by a remote system (e.g., a remote performance system or a remote ensemble system).

FIG. 2 is a block diagram of an exemplary automatic playing device according to some embodiments of the present disclosure. As illustrated in FIG. 2, automatic playing device 110 may include an automatic playing apparatus 210, a manual playing apparatus 220, an I/O apparatus 230, a controller 240, and a memory 250.

Automatic playing apparatus 210 may be configured to perform music automatically. In some embodiments, automatic playing apparatus 210 may include a keyboard, one or more pedals, hammers, dampers, a motion driver that drives the keyboard and/or the pedals, etc. Functions of the motion driver will be discussed in more detail in connection with FIG. 4. Manual playing apparatus 220 may be configured to be played by a user for music performance. In some embodiments, manual playing apparatus 220 may share some components with automatic playing apparatus 210 (e.g., a keyboard, one or more pedals, hammers, dampers, etc.). In some embodiments, manual playing apparatus 220 may be completely independent from automatic playing apparatus 210.

I/O apparatus 230 may be configured to information input from and/or output to user or components of automatic playing system 100. In some embodiments, the I/O apparatus 230 may include a key, a string, a switch, a button, a keyboard, a display, or the like, or any combination thereof. In some embodiments, the display may include a liquid crystal display (LCD), a light-emitting diode display (LED), an organic light emitting diode display (OLED), a quantum LED display (QLED), a flat panel display or curved screen, a cathode ray tube (CRT), a 3D display, a plasma display panel, or the like, or any combination thereof.

Controller 240 may be configured to control the performance of automatic playing device 110. In some embodiments, controller 240 may control the selection of a working mode including, for example, an automatic playing mode, a semi-automatic playing mode, and/or a manual playing mode. In some embodiments, controller 240 may control operations of automatic playing apparatus 220. For example, controller 240 may control movements of a key, a hammer, a damper, a pedal, and/or a motion driver. In some embodiments, controller 240 may be incorporated into processor 120.

Memory 250 may be configured to store information and/or data collected or generated by I/O apparatus 230. The information and/or data may include, for example, programs, software, algorithms, functions, files, parameters, text, numbers, images, or the like, or any combination thereof. In some embodiments, memory 250 may be incorporated into processor 120 or database 140 in FIG. 1.

It should be noted that the above description about automatic playing device 110 is merely for the purposes of illustration, and not intended to limit the scope of the present disclosure. For persons having ordinary skills in the art, multiple variations and modifications may be made under the teaching of the present disclosure. In some embodiments, automatic playing device 110 may include some other components, such as a communication interface, a power source, etc. In some embodiments, controller 240 may be incorporated into processor 120. In some embodiments, memory 250 may be omitted from automatic playing device 110 and/or incorporated into database 140 in FIG. 1. However, those variations and modifications do not depart from the scope of the present disclosure.

Figure 3:
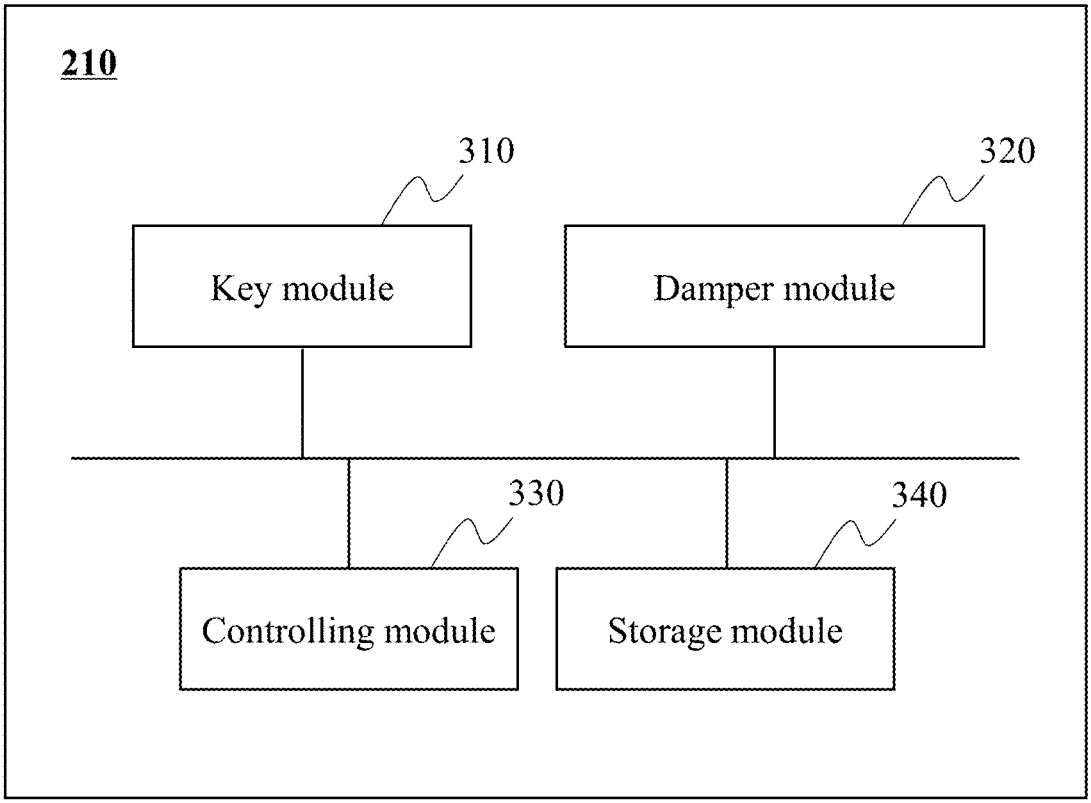
FIG. 3 is a block diagram of an exemplary automatic playing apparatus according to some embodiments of the present disclosure.

FIG. 3 is a block diagram of an example of an automatic playing apparatus according to some embodiments of the present disclosure. As illustrated, automatic playing apparatus 210 may include a key module 310, a damper module 320, a controlling module 330, and a storage module 340.

Key module 310 may be configured to perform functions of a keyboard (e.g., keyboard 111 of FIG. 1). For example, key module 310 may include a motion driver that drives a key of keyboard 111. The motion driver may drive a hammer corresponding to the key to strike a string corresponding to the key. Then a sound may be generated.

Figure 4:
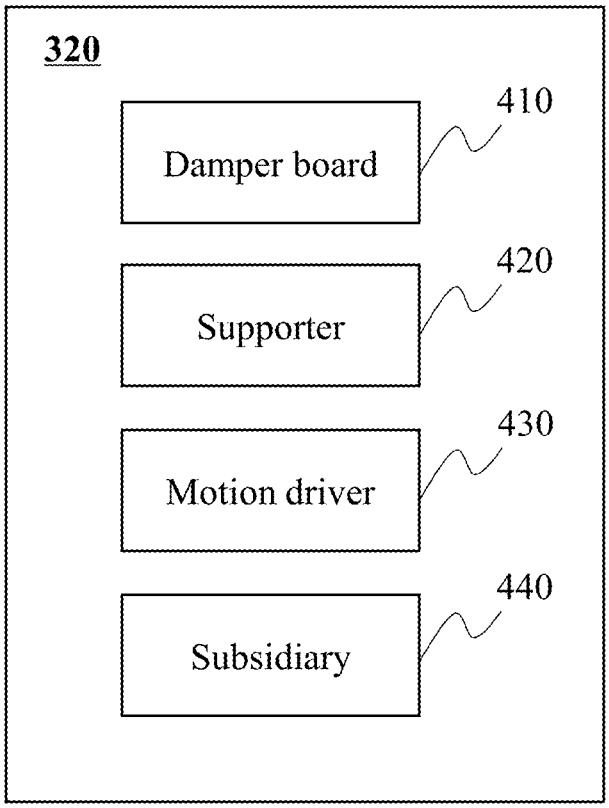
FIG. 4 is a block diagram of an exemplary damper module according to some embodiments of the present disclosure.
Figure 5:
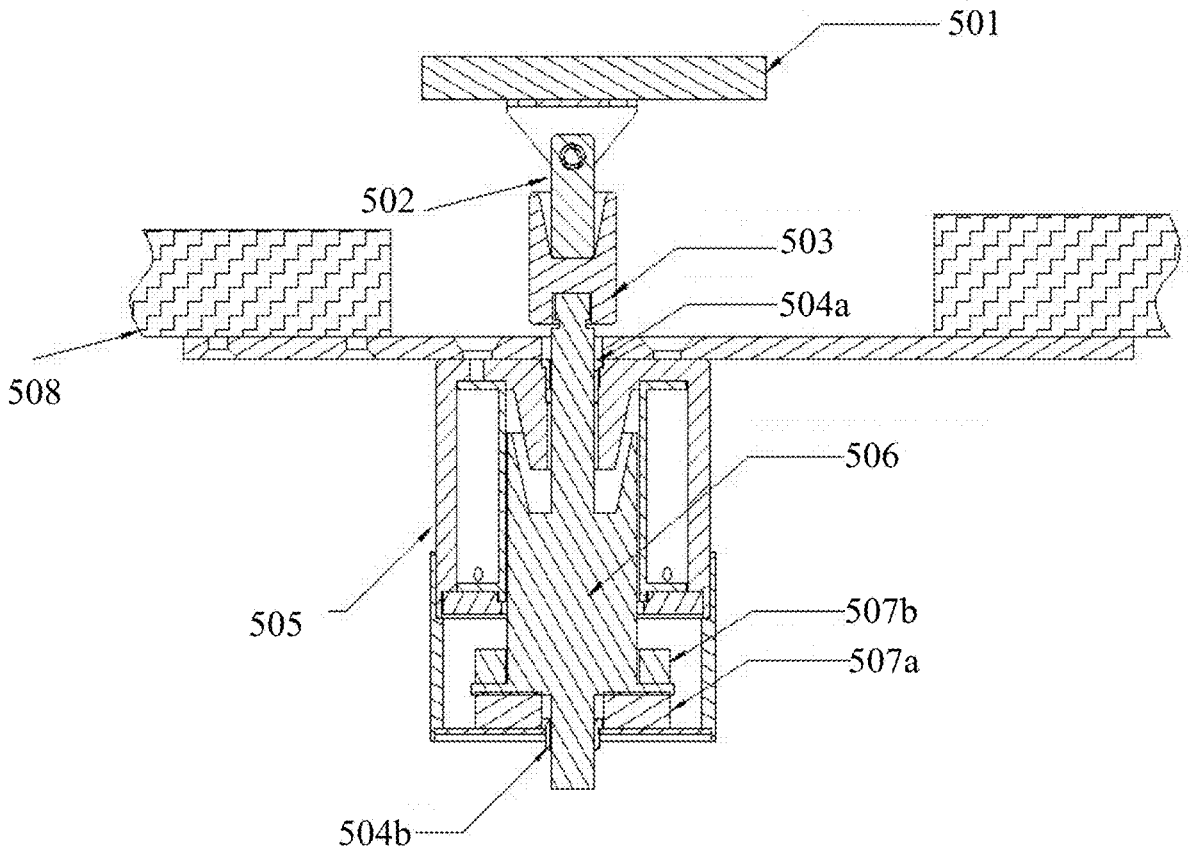
FIG. 5 illustrates a sectional view of an exemplary damper assembly according to some embodiments of the present disclosure.
Figure 6:
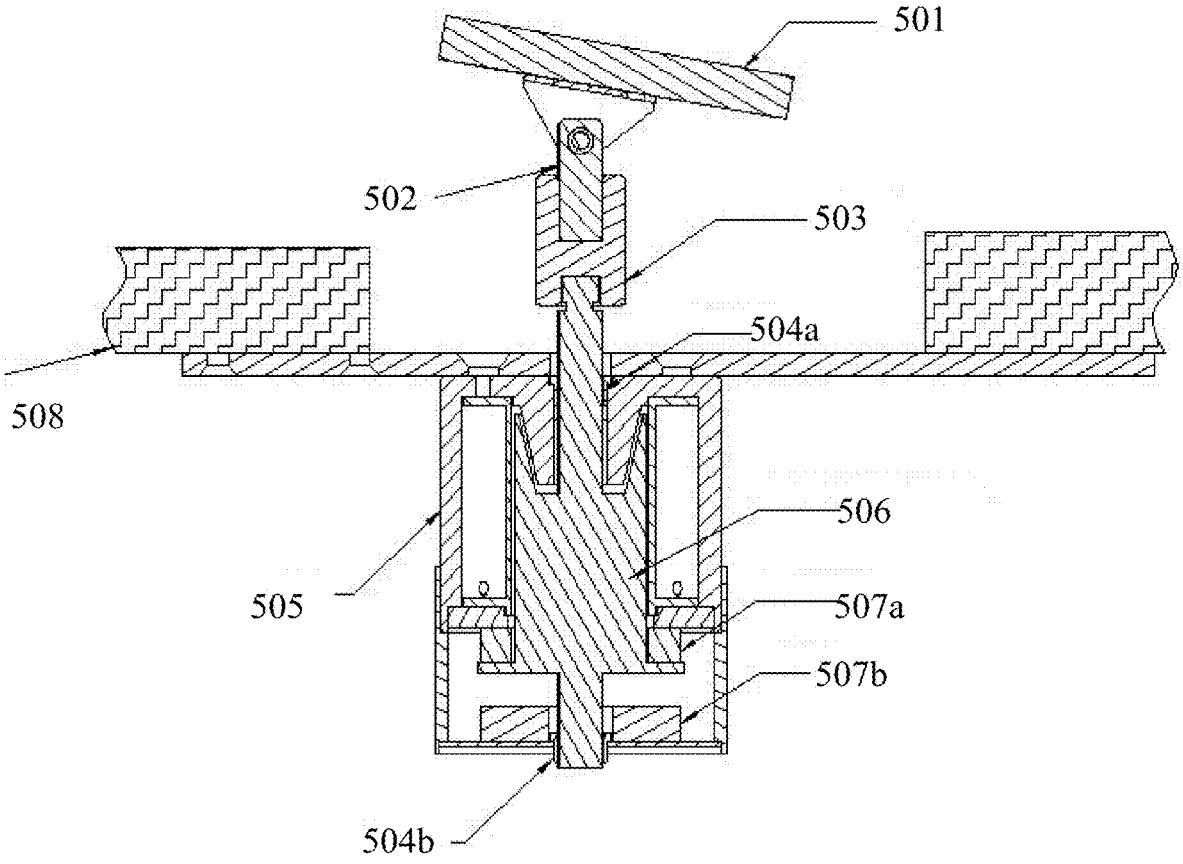
FIG. 6 illustrates a sectional view of an exemplary damper assembly according to some embodiments of the present disclosure.

Damper module 320 may be configured to perform functions of one or more pedals such as soft pedal 113, sostenuto pedal 114, and/or damper pedal 115. For example, damper module 320 may include a motion driver that drives one or more dampers. The one or more dampers may move away from the corresponding strings to change sounds generated by automatic playing system 100 (e.g., by producing one or more sound effects, such as a sustaining effect, a soft effect, etc.). In some embodiments, damper module 320 may be and/or include one or more damper modules as illustrated in FIG. 4 and/or damper assemblies as illustrated in FIGS. 5 and 6.

Controlling module 330 may be configured to control operations of key module 310 and/or damper module 320. For example, controlling module 330 may regulate the cooperation of key module 310 and damper module 320 in the automatic playing mode. Controlling module 330 may control movements of a key, a hammer, a damper, and/or a motion driver. In some embodiments, controlling module 330 may be omitted from automatic playing apparatus 220 and/or incorporated into controller 240 in FIG. 2 and/or processor 120 in FIG. 1.

Storage module 340 may be configured to store information and/or data that can be used by one or more components of automatic playing apparatus 210. The information and/or data may include, for example, programs, software, algorithms, functions, files, parameters, text, numbers, images, or the like, or any combination thereof. In some embodiments, storage module 340 may be omitted from automatic playing apparatus 220 and/or incorporated into memory 250 in FIG. 2 and/or database 140 in FIG. 1.

It should be noted that the above description about automatic playing apparatus 210 is merely for the purposes of illustration, and not intended to limit the scope of the present disclosure. For persons having ordinary skills in the art, multiple variations and modifications may be made under the teaching of the present disclosure. In some embodiments, automatic playing apparatus 210 may include some other components, such as a communication interface, a power source, etc. In some embodiments, controlling module 330 and/or storage module 340 may be omitted and/or incorporated into one module. However, those variations and modifications do not depart from the scope of the present disclosure.

FIG. 4 is a block diagram of an example of a damper module according to some embodiments of the present disclosure. As illustrated in FIG. 4, damper module 320 may include a damper board 410, a supporter 420, a motion driver 430, and a subsidiary 440.

Damper board 410 may be configured to control one or more dampers of strings in automatic playing device 110. For example, damper board 410 may be coupled with one or more dampers, and damper board 410 may control strings through controlling movements of the one or more dampers.

Motion driver 430 can drive damper board 410 and/or control movements of one or more dampers to control vibrations of strings. In some embodiments, motion driver 430 may include a solenoid, an iron core, and/or any other component for controlling movements of damper board 410 and/or one or more dampers. In some embodiments, when driven by motion driver 430, damper board 410 may attach to one or more dampers. The one or more dampers may move away from the strings. Then sounds generated by the strings may be prolonged. Functions of the damper board 410 will be discussed in more detail in connection with FIGS. 5 and 6.

Supporter 420 may be configured to support damper board 410. In some embodiments, manual playing apparatus 220 and automatic playing apparatus 210 may use respective supporters (e.g., two separate supporters corresponding to manual playing apparatus 220 and automatic playing apparatus 210, respectively). Supporter 420 may be coupled with damper board 410 directly or indirectly. For example, supporter 420 may be fixed with damper board 410 through gluing, riveting, pressing, casting, pining, buttoning, sticking, clasping, plugging, or the like, or any combination thereof. As another example, supporter 420 may include a triangle bracket and a mandrel (not shown in FIG. 4). The triangle bracket may couple damper board 420 with the mandrel of supporter 420. In some embodiments, the triangle bracket may be coupled with the mandrel by a screw, to make the triangle bracket rotate freely in one or more directions.

Motion driver 430 may be configured to drive damper board 410. In some embodiments, motion driver 430 may be controlled by controlling module 330 to perform automatic playing functions (e.g., when automatic playing device 110 implements an automatic playing mode, a semi-automatic playing mode, etc.). Controlling module 330 may analyze the performance information in storage module 340, memory 250, or database 140, and generate a control signal to control the motion of motion driver 430. For example, controlling module 330 may control the status of the current that supplies power to motion driver 430 (e.g., a magnitude, frequency, duration time, etc. of the current). Functions of the motion driver 430 will be discussed in more detail in connection with FIGS. 5 and 6.

Subsidiary 440 may be configured to facilitate operations of damper board 410, supporter 420, and/or motion driver 430. In some embodiments, subsidiary 440 may include a screw, a bushing, an elastic sleeve, a silencer, or the like, or any combination thereof. In some embodiments, the screw may be used to fix motion driver 430 with keybed 112. In some embodiments, the bushing may be made of polyformaldehyde or nylon. In some embodiments, the elastic sleeve may be installed at a bottom part of supporter 420. In some embodiments, the silencer may be made of woolen felt, or cotton.

FIGS. 5 and 6 illustrate sectional views of an exemplary damper assembly according to some embodiments of the present disclosure. The damper assembly may include a damper board 501 (corresponding to damper board 410 in FIG. 4), a supporter 502 (corresponding to supporter 420 in FIG. 4), an elastic sleeve 503, bushings 504*a* and 504*b*, a solenoid 505, an iron core 506, silencers 507*a* and 507*b*, and a keybed 508 (corresponding to keybed 112 in FIG. 1). In some embodiments, the damper assembly may operate to implement one or more working modes for an automatic playing system, such as a manual playing mode, an automatic playing mode, a semi-automatic playing mode, etc.

Damper board 501 may be configured to control strings of the automatic playing device 110. For example, damper board 501 may be coupled with one or more dampers, and damper board 501 may control strings through controlling movements of the one or more dampers. Supporter 502 may be configured to support damper board 501. In some embodiments, the automatic playing apparatus 210 may share damper board 501 with manual playing apparatus 220. Thus automatic playing device 110 may include two supporters for automatic playing apparatus 210 and manual playing apparatus 220, respectively. There may be an elastic sleeve 503 surrounding the bottom part of supporter 502. There may be an opening at the top part of elastic sleeve 503. In some embodiments, elastic sleeve 503 may be made of rubber.

Motion driver 430 in FIG. 4 may include a solenoid 505 and an iron core 506. Motion driver 430 may be fixed with keybed 508 through different connection manners including, for example, gluing, welding, riveting, pressing, casting, pinning, buttoning, tying, sticking, clasping, plugging, screw connection, or the like, or any combination thereof. When motion driver 430 is operated, solenoid 505 may generate a magnetic field that can induce iron core 506 to move upward. When motion driver 430 is not operated, iron core 506 may stay in a state of rest. Iron core 506 may be divided into three portions from top to bottom: a first portion, a second portion, and a third portion. The first portion of the iron core may pass through a plate above motion driver 430 through a hole. The diameter of the second portion of iron core 506 may be larger than the diameter of the first portion and/or the third portion of iron core 506. The second portion of iron core 506 may include a rim near the junction of the second portion and the third portion. The top part of the first portion of iron core 506 may be inserted into an opening of the bottom part of elastic sleeve 503 and may be coupled with the bottom part of elastic sleeve 503. Solenoid 505 may include a coil and a cavity. The coil may be configured to generate a magnetic field when motion driver 430 is operated. The cavity may be installed beneath the coil. The second portion of the iron core may be encircled by the coil of the solenoid. The cavity may include a hole in the bottom. The hole may be configured to guide the third portion of iron core 506 to pass through.

Silencer 507 may include a first silencer 507*a* and a second silencer 507*b*. The first silencer 507*a* may be installed on the bottom of the cavity and the second silencer 507*b* may be installed on the rim of the second portion of iron core 506. In some embodiments, silencer 507 may be made of woolen felt. In some embodiments, the damper assembly may also include bushings 504*a* and 504*b* that may be configured to decrease friction. Bushing 504*a* may be installed in the hole of the plate above motion driver 430. Bushing 504*b* may be installed in the hole of the cavity beneath solenoid 505.

In some embodiments, motion driver 430 may be operated to perform one or more automatic playing functions of the automatic playing system 100 and/or to implement a first mode (e.g., an automatic playing mode, a semi-automatic playing mode, etc.) for the automatic playing system 100. When motion driver 430 is not operated, a second mode (e.g., a manual playing mode, a semi-automatic playing mode, etc.) may be implemented to enable a user to play the automatic playing system 100. In the second mode, one or more of the automatic playing functions are not performed. For example, as illustrated in FIG. 5, motion driver 430 is not operated. The first portion of iron core 506 along with elastic sleeve 503 may be spaced apart from supporter 502. In some embodiments, movements of damper board 501 may be controlled by another supporter, for example, a second supporter (not shown in FIG. 5). For example, in the manual playing mode, damper board 501 may be coupled with the second supporter, and the second supporter may be coupled with damper pedal 115 through a damper pedal linkwork, for example, a lever (not shown in FIG. 5). When damper pedal 115 is depressed, damper board 501 may cause one or more dampers to move away from strings of automatic playing device 110. Then sounds generated by the strings may sustain until the vibration(s) of the strings naturally ceases and/or until damper pedal 115 is released.

As illustrated in FIG. 6, motion driver 430 is operated. For example, in the automatic playing mode, the coil of solenoid 505 may generate a magnetic field that can induce motion of iron core 506 (e.g., linear motion). The first portion of iron core 506 along with elastic sleeve 503 may be in contact with supporter 502. Damper board 501 may be raised up by supporter 502 when iron core 506 is moving upward. Damper board 501 may cause one or more dampers to move away from strings of automatic playing device 110.

It should be noted that the above description about damper module 320 is merely for the purposes of illustration, and not intended to limit the scope of the present disclosure. For persons having ordinary skills in the art, multiple variations and modifications may be made under the teaching of the present disclosure. Positions, structures and/or assemblies of damper module 320 may be varied. For example, the cavity beneath coil may be optional. As another example, there may be a damper pedal linkwork coupled with the third portion of the iron core 506. However, those variations and modifications do not depart from the scope of the present disclosure.

Having thus described the basic concepts, it may be rather apparent to those skilled in the art after reading this detailed disclosure that the foregoing detailed disclosure is intended to be presented by way of example only and is not limiting. Various alterations, improvements, and modifications may occur and are intended to those skilled in the art, though not expressly stated herein. These alterations, improvements, and modifications are intended to be suggested by this disclosure, and are within the spirit and scope of the exemplary embodiments of this disclosure.

Moreover, certain terminology has been used to describe embodiments of the present disclosure. For example, the terms "one embodiment," "an embodiment," and/or "some embodiments" mean that a particular feature, structure or characteristic described in connection with the embodiment is included in at least one embodiment of the present disclosure. Therefore, it is emphasized and should be appreciated that two or more references to "an embodiment" or "one embodiment" or "an alternative embodiment" in various portions of this specification are not necessarily all referring to the same embodiment. Furthermore, the particular features, structures or characteristics may be combined as suitable in one or more embodiments of the present disclosure.

Further, it will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, micro-code, etc.) or combining software and hardware implementation that may all generally be referred to herein as a "block," "module," "engine," "unit," "component," or "system." Furthermore, aspects of the present disclosure may take the form of a computer program product embodied in one or more computer readable media having computer readable program code embodied thereon.

What is claimed is:

1. An automatic playing system comprising:

a damper module for changing a sound generated by the automatic playing system, the damper module comprising:

a damper board configured to control at least one damper of the automatic playing system;

a motion driver configured to drive the damper board, wherein:

the motion driver comprises a solenoid and an iron core, from top to bottom, the iron core includes: a first portion, a second portion, and a third portion, and a diameter of the second portion is larger than at least one of a diameter of the first portion or a diameter of the third portion; and a supporter configured to couple the damper board with the motion driver when the motion driver is operated, wherein the motion driver is operated to perform at least one automatic playing function.

2. The system of claim 1, wherein the at least one damper is configured to control movements of at least one string of the automatic playing system.

3. The system of claim 1, when the motion driver is operated to perform the automatic playing function, the iron core moves upward and the damper board is raised up by the iron core through the supporter.

4. The system of claim 3, when the damper board is raised up, the damper board causes the at least one damper to move away from at least one string of the automatic playing system.

5. The system of claim 1, wherein the first portion of the iron core is in contact with the supporter when the motion driver is operated.

6. The system of claim 1, wherein the first portion of the iron core is spaced apart from the supporter when the motion driver is not operated.

7. The system of claim 1, wherein the solenoid further comprises:

a coil configured to generate a magnetic field when the motion driver is operated; and a cavity installed beneath the coil.

8. The system of claim 7, wherein the second portion of the iron core is encircled by the coil of the solenoid.

9. The system of claim 7, wherein the cavity of the solenoid comprises a hole configured to guide the third portion of the iron core to pass through the cavity of the solenoid.

10. The system of claim 9, wherein the damper module comprises a bushing installed in the hole of the cavity.

11. The system of claim 10, wherein the bushing is made of polyformaldehyde.

12. The system of claim 7, wherein the damper module comprises a first silencer installed on a bottom of the cavity.

13. The system of claim 12, wherein the second portion of the iron core comprises a rim near a junction of the second portion and the third portion of the iron core.

14. The system of claim 13, wherein the damper module comprises a second silencer installed on the rim of the second portion of the iron core.

15. The system of claim 12, wherein the first silencer is made of woolen felt.

16. The system of claim 1, wherein the damper module comprises an elastic sleeve installed on a part of the supporter.

17. The system of claim 16, wherein the elastic sleeve is made of rubber.

18. The system of claim 1, wherein the automatic playing system further comprises a keybed configured to be fixed with the motion driver.

* * * * *